US009182711B2

(12) United States Patent
Murayama

(10) Patent No.: US 9,182,711 B2
(45) Date of Patent: Nov. 10, 2015

(54) IMAGE FORMING DEVICE FOR SUPPRESSING POWER CONSUMPTION BY FIXING UNIT

(71) Applicant: Brother Kogyo Kabushiki Kaisha, Nagoya-shi, Aichi-ken (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/265,414

(22) Filed: Apr. 30, 2014

(65) Prior Publication Data

US 2014/0321870 A1 Oct. 30, 2014

(30) Foreign Application Priority Data

Apr. 30, 2013 (JP) ..... 2013-095934

(51) Int. Cl.
*G03G 15/20* (2006.01)

(52) U.S. Cl.
CPC ..... *G03G 15/2046* (2013.01); *G03G 15/2039* (2013.01); *G03G 15/2078* (2013.01)

(58) Field of Classification Search
CPC ..... G03G 15/2078; G03G 15/2039; G03G 15/2046
USPC ..... 399/67, 69, 43, 85
See application file for complete search history.

(56) References Cited

U.S. PATENT DOCUMENTS

| | | | | |
|---|---|---|---|---|
| 6,011,938 | A * | 1/2000 | Toizumi | 399/69 |
| 6,778,789 | B2 * | 8/2004 | Cho et al. | 399/69 |
| 2005/0047811 | A1 * | 3/2005 | Sato | 399/69 |
| 2005/0191074 | A1 * | 9/2005 | Matsumoto | 399/69 |
| 2008/0165377 | A1 | 7/2008 | Ishii | |
| 2011/0262158 | A1 | 10/2011 | Hitoshi | |
| 2012/0141155 | A1 * | 6/2012 | Suzumi | 399/70 |
| 2012/0212778 | A1 | 8/2012 | Sakai | |
| 2013/0322906 | A1 * | 12/2013 | Takatsuka | 399/69 |

FOREIGN PATENT DOCUMENTS

| | | | |
|---|---|---|---|
| JP | H04-181980 | A | 6/1992 |
| JP | H06-202423 | A | 7/1994 |
| JP | H10-186933 | A | 7/1998 |
| JP | H10-319788 | A | 12/1998 |
| JP | 2000-284632 | A | 10/2000 |
| JP | 2003-066765 | A | 3/2003 |
| JP | 2004-054086 | A | 2/2004 |
| JP | 2006-235043 | A | 9/2006 |
| JP | 2007-047924 | A | 2/2007 |

(Continued)

*Primary Examiner* — Rodney Bonnette
(74) *Attorney, Agent, or Firm* — Banner & Witcoff, Ltd.

(57) ABSTRACT

An image forming device includes a toner-image forming unit; a heating unit; and a processor. The toner-image forming unit is configured to form a toner image on a sheet using toner. The heating unit is configured to generate heat for thermally fixing the toner image to the sheet. The processor is configured to perform a first fixing process to control the heating unit to start generating heat in a first mode, and a second fixing process to switch the first mode to a second mode at a switch timing ahead of an estimated end timing at which thermal fixing of toner images to all sheets to be consecutively printed is completed. The heat amount per unit time generated by the heating unit in the second mode is smaller than a heat amount per unit time generated by the heating unit in the first mode.

25 Claims, 8 Drawing Sheets

(56) References Cited

FOREIGN PATENT DOCUMENTS

| | | | |
|---|---|---|---|
| JP | 2007-083699 | A | 4/2007 |
| JP | 2008-185702 | A | 8/2008 |
| JP | 2008-275833 | A | 11/2008 |
| JP | 2010-167705 | A | 8/2010 |
| JP | 2011-242746 | A | 12/2011 |
| JP | 2012-008911 | A | 1/2012 |
| JP | 2012-171138 | A | 9/2012 |

* cited by examiner

IMAGE FORMING DEVICE FOR SUPPRESSING POWER CONSUMPTION BY FIXING UNIT

CROSS REFERENCE TO RELATED APPLICATION

This application claims priority from Japanese Patent Application No. 2013-095934 filed Apr. 30, 2013. The entire content of the priority applications is incorporated herein by reference.

TECHNICAL FIELD

The present invention relates to a technique of temperature control by a fixing unit provided in an image forming device.

BACKGROUND

One conventional image forming device provided with a fixing unit for thermally fixing a toner image formed on a sheet has the following structure (see Japanese Patent Application No. 2011-242746). This conventional image forming device has a temperature detection unit that detects the temperature of the fixing unit. At the beginning of a printing operation, the image forming device determines whether the number of sheets to be printed is greater than a prescribed number and enters either (1) a first mode for supplying the first sheet to be printed once the temperature detected by the temperature detection unit exceeds a first temperature when the number of sheets is greater than the prescribed number or (2) a second mode for supplying the first sheet to be printed once the detected temperature exceeds a second temperature lower than the first temperature when the number of sheets is no greater than the prescribed number.

SUMMARY

However, once a conventional image forming device such as that described above begins an image-forming process to form a toner image on a sheet and to thermally fix the toner image to the sheet, the device does not change the temperature setting of the fixing unit at least until the image-forming process has been completed. Hence, the heat value per unit time produced by the fixing unit is maintained uniform. However, once the image-forming process has ended, the heat generated by the fixing unit merely serves to raise the ambient temperature around the fixing unit, leading to wasteful power consumption by the fixing unit.

In view of the foregoing, it is an object of the present invention to provide a technique for suppressing power consumption by the fixing unit of image forming device better than a technique for maintaining the fixing unit at a uniform heat value per unit time until the image-forming process has ended.

In order to attain the above and other objects, the present invention provides an image forming device that includes a conveying unit; a toner container; a toner-image forming unit; a heating unit; and a processor. The conveying unit is configured to convey a sheet. The toner container is configured to contain toner therein. The toner-image forming unit is configured to form a toner image on the sheet conveyed by the conveying unit using the toner contained in the toner container. The heating unit is configured to generate heat for thermally fixing the toner image to the sheet. The processor is configured to perform a first fixing process and a second fixing process. In the first fixing process, the processor controls the heating unit to start generating heat in a first mode. In the second fixing process, the processor switches the first mode to a second mode at a switch timing ahead of an estimated end timing at which thermal fixing of toner images to all sheets to be consecutively printed is completed. The heat amount per unit time generated by the heating unit in the second mode is smaller than a heat amount per unit time generated by the heating unit in the first mode.

According to another aspect, the present invention provides a method of forming an image using a heating unit for thermal fixing a toner image to a sheet. The method includes (a) performing a first fixing process; and (b) performing a second fixing process. In the first fixing process, the heating unit starts generating heat in a first mode. In the second fixing process, the first mode is switched to a second mode at a switch timing ahead of an estimated end timing at which thermal fixing of toner images to all sheets is completed. A heat amount per unit time generated by the heating unit in the second mode is smaller than a heat amount per unit time generated by the heating unit in the first mode.

According to further another aspect, the present invention provides a non-transitory computer readable storage medium storing a set of program instructions installed on and executed by an image forming device. The set of program instructions includes (a) performing a first fixing process; and (b) performing a second fixing process. In the first fixing process, the heating unit starts generating heat in a first mode. In the second fixing process, the first mode is switched to a second mode at a switch timing ahead of an estimated end timing at which thermal fixing of toner images to all sheets is completed. A heat amount per unit time generated by the heating unit in the second mode is smaller than a heat amount per unit time generated by the heating unit in the first mode.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
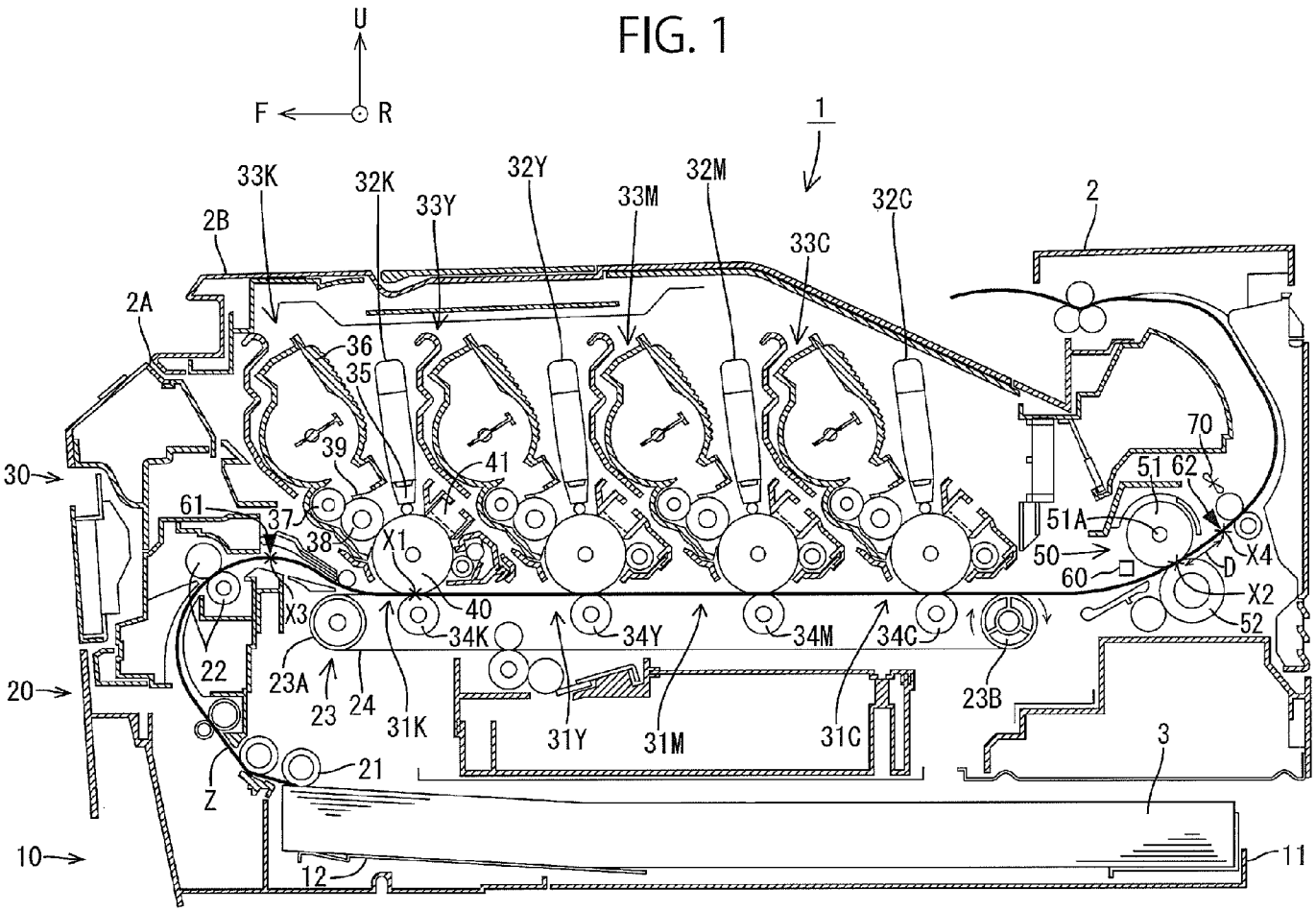
FIG. 1 is a schematic cross-sectional view illustrating a printer according to a preferred embodiment of the present invention.

Next, a printer 1 serving as a preferred embodiment of the present invention will be described while referring to FIGS. 1 through 8. In the following description, the left side of the printer 1 in FIG. 1 will be considered the front side (F), the near side of the printer 1 in FIG. 1 will be considered the right side (R), and the top of the printer 1 in FIG. 1 will be considered the upper side (U). The bold line in FIG. 1 depicts a conveying path Z of sheets 3 for a printing operation.

The printer 1 is an example of an image forming device according to the present invention. In the preferred embodiment, the printer 1 is a tandem-type color printer employing a multiple transfer system capable of executing both monochrome and color printing. Monochrome printing is an operation for forming a monochromatic image using black toner, for example. Color printing is an operation for forming a color image using toner in the four colors black, yellow, magenta, and cyan, for example. When it is necessary to distinguish among components of the printer 1 or terms by the color they are associated with, suffixes K, Y, M, and C denoting the colors black, yellow, magenta, and cyan, respectively, are appended to the reference numerals of the components and the like.

(Overall Structure of the Printer)

As shown in FIG. 1, the printer 1 is configured of a casing 2 and, disposed within the casing 2, a sheet-accommodating unit 10, a conveying unit 20, and an image-forming unit 30.

The casing 2 has a general box-like shape and includes an opening 2A formed in its top surface, and a cover 2B disposed over the opening 2A. The rear edge of the cover 2B is rotatably coupled to a top portion of the casing 2, enabling the cover 2B to be displaced between a closed position shown in FIG. 1 for closing the opening 2A, and an open position for exposing the opening 2A. The operator can rotate the cover 2B into the open position in order to replace such components as a belt unit 23, and process units 33K, 33Y, 33M, and 33C described later.

The sheet-accommodating unit 10 is provided in the bottom section of the casing 2. The sheet-accommodating unit 10 is provided with a tray 11, and a lifting member 12. The tray 11 can accommodate a plurality of sheets 3 of paper, transparencies, and the like in a stacked state. The lifting member 12 is provided in the tray 11 and functions to press the front end of the sheets 3 accommodated in the tray 11 upward.

The conveying unit 20 includes a pickup roller 21, registration rollers 22, and a belt unit 23 for feeding sheets 3 accommodated in the sheet-accommodating unit 10 onto the conveying path Z one at a time and for conveying the sheets 3 along the conveying path Z. The pickup roller 21 is provided above the front end of the tray 11 and contacts the top of the stack of sheets 3 accommodated in the sheet-accommodating unit 10 at the front end of the sheets 3 that is pushed upward by the lifting member 12. When driven to rotate, the pickup roller 21 feeds the topmost sheet 3 in the tray 11 toward the registration rollers 22 one at a time. After correcting skew in the sheet 3, the registration rollers 22 convey the sheet 3 toward the belt unit 23.

The belt unit 23 includes a pair of support rollers 23A and 23B, and a belt 24. The belt 24 is formed in a loop shape and is placed around the pair of support rollers 23A and 23B. When the support roller 23B on the rear side is driven to rotate, the belt 24 circulates clockwise in FIG. 1 for conveying a sheet 3 resting on the top surface of the belt 24 rearward. Four transfer rollers 34K, 34Y, 34M, and 34C constituting the image-forming unit 30 described below are disposed within the loop formed by the belt 24. The transfer rollers 34K, 34Y, 34M, and 34C are positioned to confront photosensitive members 40 of respective process units 33K, 33Y, 33M, and 33C described later, with the belt 24 interposed therebetween.

The image-forming unit 30 is disposed above the belt unit 23. The image-forming unit 30 is provided with four toner-image forming units 31K, 31Y, 31M, and 31C corresponding to the colors black, yellow, magenta, and cyan; and a fixing unit 50. The toner-image forming units 31K, 31Y, 31M, and 31C are juxtaposed in the conveying direction of the belt 24, i.e., along the front-rear direction.

The toner-image forming units 31K, 31Y, 31M, and 31C have the same structure and operation, differing only in the color of toner employed. Therefore, the structure and operations of the toner-image forming units 31K, 31Y, 31M, and 31C will be described using the black toner-image forming unit 31K as a representative example. The black toner-image forming unit 31K forms toner images in black directly on the belt 24 or indirectly on the belt 24 with a sheet 3 interposed therebetween. The black toner-image forming unit 31K has an exposure unit 32K, a process unit 33K, and a transfer roller 34K.

The exposure unit 32K has an LED head 35. The LED head 35 includes a plurality of LEDs (not shown) that are arrayed in the left-right direction of the printer 1. Therefore, the left-right direction relative to the printer 1 is the main scanning direction, while the front-rear direction is the sub-scanning direction. The exposure unit 32K is controlled to emit light based on image data for an image to be formed on the sheet 3, exposing the surface of the corresponding photosensitive member 40. That is, the LED head 35 of the exposure unit 32K irradiates light toward the surface of the photosensitive member 40 one scan line at a time.

The process unit 33K has a toner-accommodating chamber 36, a supply roller 37, a developing roller 38, and a thickness-regulating blade 39. The toner-accommodating chamber 36 is an example of a toner container, and accommodates black toner, which is a type of colorant. Toner in the toner-accommodating chamber 36 is supplied onto the supply roller 37, which in turn supplies the toner onto the developing roller 38 while the toner is positively tribocharged between the supply roller 37 and developing roller 38. The toner carried on the developing roller 38 is further tribocharged between the developing roller 38 and thickness-regulating blade 39 as the thickness-regulating blade 39 regulates the toner in a thin layer of uniform thickness.

The process unit 33K also has a photosensitive member 40, and a scorotron charger 41. The surface of the photosensitive member 40 has been coated with a positive-charging photosensitive layer. When executing print control and temperature control processes described later, the printer 1 drives the photosensitive member 40 to rotate, while the scorotron charger 41 applies a uniform positive charge to the surface of the photosensitive member 40. Subsequently, the positively charged surface of the photosensitive member 40 is exposed to light emitted from the exposure unit 32K, whereby an electrostatic latent image is formed on the surface of the photosensitive member 40.

Next, toner carried on the developing roller 38 is supplied onto the latent image, developing the latent image into a visible toner image. Subsequently, the toner image carried on the surface of the photosensitive member 40 is transferred onto a sheet 3 by applying a negative transfer voltage to the transfer roller 34K as a sheet 3 passes through a transfer position X1 between the photosensitive member 40 and transfer roller 34K.

The fixing unit 50 is an example of a heating unit. The fixing unit 50 has a heating roller 51, and a pinch roller 52. The fixing unit 50 functions to convey a sheet 3 carrying toner images transferred by the toner-image forming units 31 while thermally fixing the toner images to the sheet 3. More specifically, the heating roller 51 has an internally provided heat source 51A, such as a halogen lamp. The temperature of the heat source 51A can be controlled by a control unit 80 described later. The pinch roller 52 is disposed so as to confront the heating roller 51 from the opposite side of the conveying path Z, and applies pressure to the heating roller 51. Hereinafter, the position at which the heating roller 51 and pinch roller 52 press against each other sill be called a fixing position X2. The fixing position X2 is downstream of the transfer position X1 along the conveying path Z. Sheets 3 whose toner images have been thermally fixed are subsequently conveyed upward and discharged onto the top surface of the casing 2.

The printer 1 is further provided with a temperature sensor 60, a registration sensor 61, a discharge sensor 62, and a fan 70, all of which are disposed in the casing 2. The temperature sensor 60 is disposed in proximity to the heating roller 51. The temperature sensor 60 detects the ambient temperature near the heating roller 51 and provides the detection results to the control unit 80 described later. The registration sensor 61 is mounted at a detection position X3 near the registration rollers 22. The registration sensor 61 is a sheet sensor that detects the presence of a sheet 3 at the detection position X3 and provides the detection results to the control unit 80. The detection position X3 is positioned on the upstream side of the transfer position X1 along the conveying path Z. Note that the detection position X3 may be upstream of or downstream of the registration rollers 22 along the conveying path Z.

The discharge sensor 62 is mounted in a detection position X4 downstream of the fixing position X2 along the conveying path Z. The discharge sensor 62 detects the presence of a sheet 3 at the detection position X4 and provides the detection results to the control unit 80 described later. The fan 70 is provided in proximity to the fixing unit 50 and functions to cool the fixing unit 50 when given to rotate. The control unit 80 is configured to control the rotational speed of the fan 70. The fan 70 may be an exhaust-type fan that draws air from around the fixing unit 50 and exhausts the air from the casing 2, or may be an intake-type fan that draws external air into the casing 2 and blows the air toward the fixing unit 50.

(Electrical Structure of the Printer)

Figure 2:
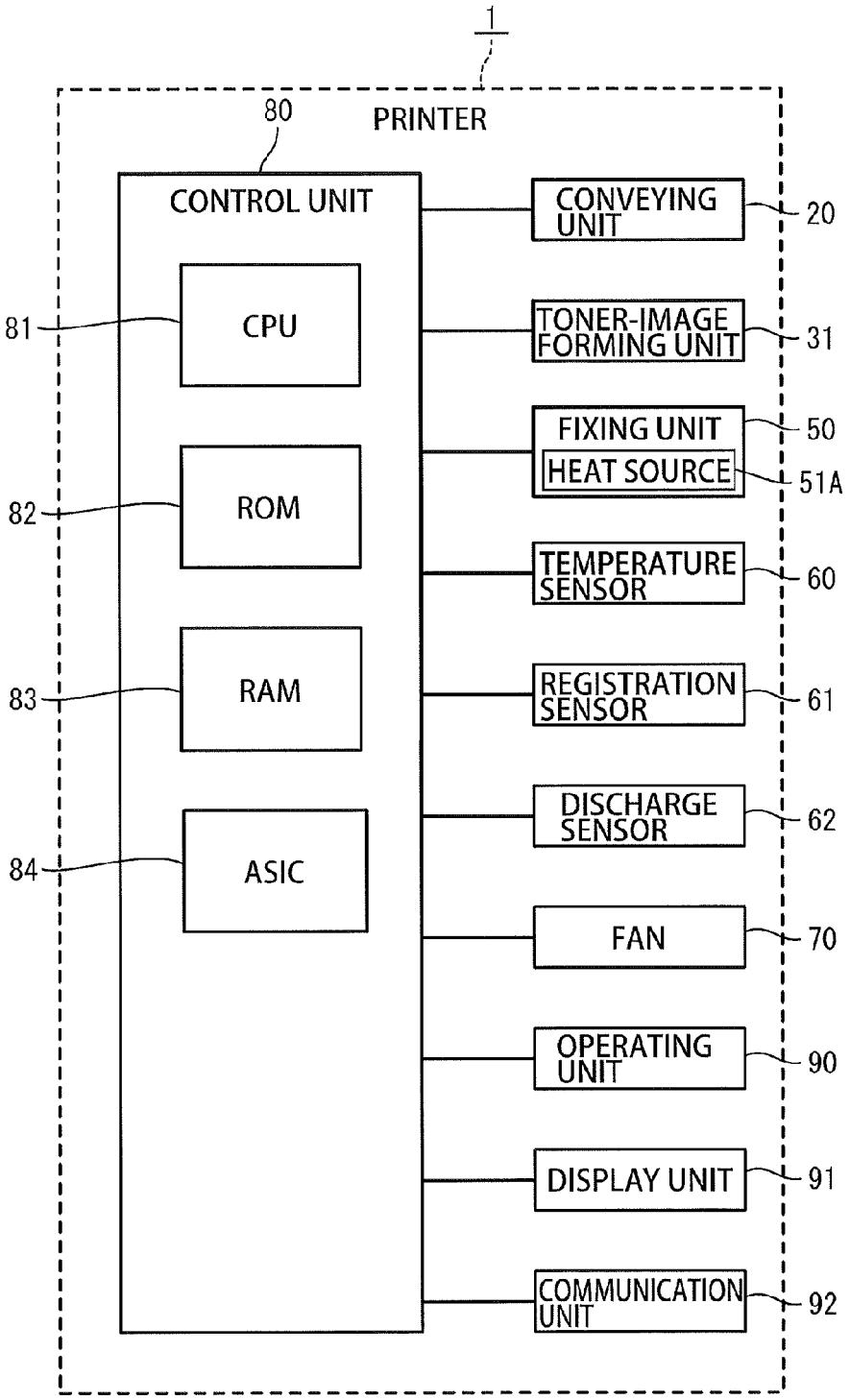
FIG. 2 is a block diagram schematically showing an electrical structure of the printer.

As shown in FIG. 2, in addition to the conveying unit 20, toner-image forming unit 31, fixing unit 50, temperature sensor 60, registration sensor 61, discharge sensor 62, and fan 70 already described, the printer 1 includes a control unit 80, an operating unit 90, a display unit 91, and a communication unit 92.

The control unit 80 includes a central processing unit (CPU) 81, a read-only memory (ROM) 82, a random access memory (RAM) 83, and an application-specific integrated circuit (ASIC) 84. The ROM 82 stores programs for executing a print control process and temperature control process described later, and programs for executing various other operations on the printer 1. The CPU 81 controls the components of the printer 1 based on programs read from the ROM 82 and loaded into the RAM 83. In addition to the ROM 82 and RAM 83, the storage medium for storing the various programs may be another type of nonvolatile memory, such as a CD-ROM, hard disk drive, or flash memory. The ASIC 84 is a hardware circuit such as a circuit dedicated to image processing.

The operating unit 90 is provided with a plurality of buttons that the user can operate to input various data. The operating unit 90 transmits an operation signal to the control unit 80 in response to the input operations. The display unit 91 includes a liquid crystal display, lamps, and the like for displaying various configuration screens and for indicating the status of the printer 1, for example. Using a wired or wireless system, the communication unit 92 can exchange data with an external data processor (not shown), such as a personal computer, over a communication network.

(Print Control and Temperature Control Processes)

Figure 3:
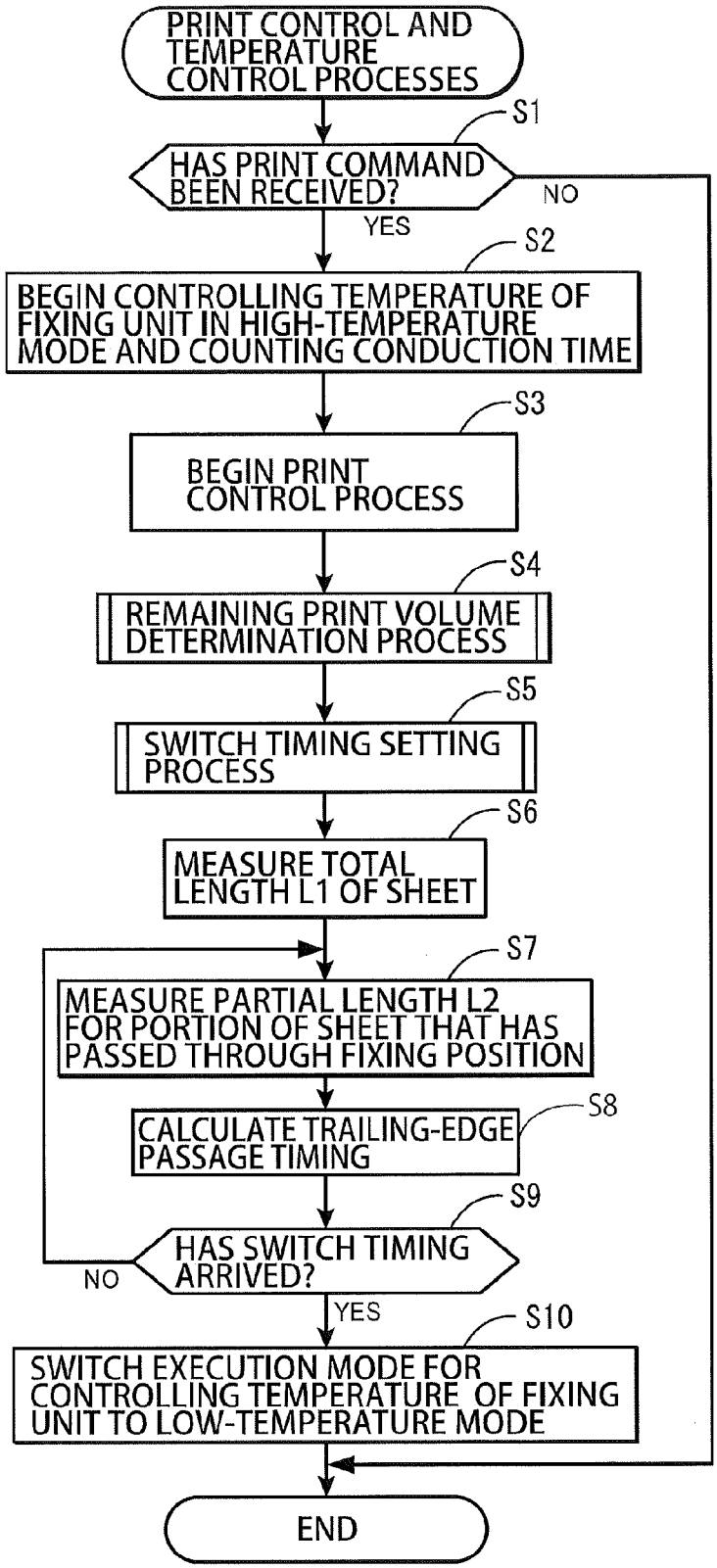
FIG. 3 is a flowchart illustrating steps in print control and temperature control processes executed by the printer.

The control unit 80 repeatedly executes the print control and temperature control processes shown in FIG. 3 at prescribed intervals after power to the printer 1 has been turns on, for example. In S1 of this process, the CPU 81 first determines whether either the operating unit 90 or communication unit 92 has received a print command. The CPU 81 determines from the operation signal received from the operating unit 90 whether the operating unit 90 has received a print command through user input operations, and determines from a signal received from the communication unit 92 whether the communication unit has received a print command from a data processor.

The print command instructs the printer 1 to execute a printing process described later. In the following description, a print command will be assumed to include print data for a target image specified by the user, a page count M indicating the number of sheets required for printing, the type of sheets 3 on which the target image is to be printed (hereinafter called the "sheet type"), and other printing conditions. The page count M indicates the number of sheets required for the print command and is determined based on the number of pages in the target image, the number of copies to be printed, and the like. The sheet type includes a normal sheet that has the same thickness as normal paper, a heavy sheet that is thicker than normal paper, and a light sheet that is thinner than normal paper, for example.

If the CPU 81 determines that a print command has not been received (S1: NO), the CPU 81 ends the print control and temperature control processes and, after a prescribed time has elapsed, repeats the process from the beginning. However, if the CPU 81 determines that a print command has been received (S1: YES; indicated at the top of FIG. 8), in S2 the CPU 81 begins supplying an electric current to the heat source 51A of the fixing unit 50 for controlling the temperature of the heat source 51A in a high-temperature mode. Specifically, using detection results from the temperature sensor 60 as feedback, the CPU 81 begins a temperature control process to adjust the value of heat produced by the heat source 51A so that the detected temperature reaches a target temperature.

When controlling the temperature in the high-temperature mode, the CPU 81 sets the target temperature to a high-temperature target value C1 (210° C., for example) that is sufficient for fixing a toner image to the sheet 3. In a low-temperature mode, the CPU 81 performs temperature control by setting the target temperature to a low-temperature target value C2 (195° C., for example), which is lower than the high-temperature target value C1. After activating the heat source 51A, in S2 the CPU 81 begins counting a conduction time during which power is supplied to the heat source 51A. The high-temperature mode is an example of a first mode of the present invention, and the low-temperature mode is an example of a second mode of the present invention.

(1) Print Control Process

Figure 4:
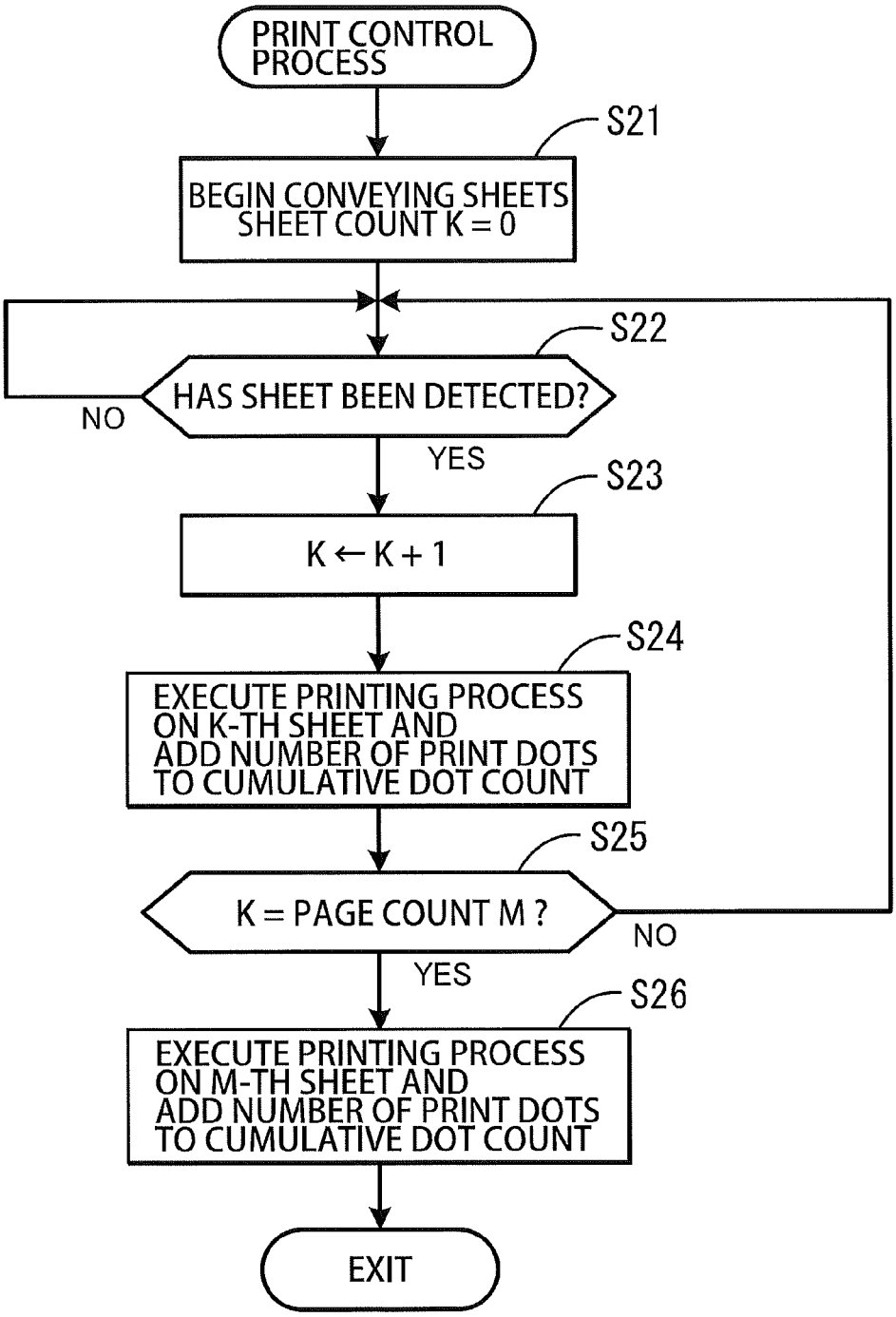
FIG. 4 is a flowchart illustrating steps in a print control process executed by the printer.

In S3 the CPU 81 begins the print control process shown in FIG. 4 in parallel with the temperature control process described later. In S21 of FIG. 4, the CPU 81 controls the conveying unit 20 to begin conveying a sheet 3 from the sheet accommodating unit 10. When the page count M in the print command indicates a plurality of pages, the CPU 81 conveys sheets 3 from the sheet-accommodating unit 10 onto the conveying path Z one at a time at fixed intervals. Through this operation, a plurality of sheets 3 is conveyed sequentially along the conveying path Z with a prescribed gap formed between consecutively fed sheets. The CPU 81 also initializes a sheet count K to 0.

After the CPU 81 has begun conveying sheets 3, in S22 the CPU 81 determines whether the leading edge of the sheet 3 has arrived at the detection position X3 based on detection results from the registration sensor 61. When the leading edge of the sheet 3 has not yet been detected (S22: NO), the CPU 81 enters a standby state while repeating the determination in S22. Once the leading edge of the sheet 3 has been detected (S22: YES; indicated in the top of FIG. 8), in S23 the CPU 81 increments the sheet count K by 1 and in S24 initiates a printing process on the K-th sheet whose leading edge was detected in S22. The printing process is an example of a first fixing process and a second fixing process of the present invention. In the printing process, the toner-image forming unit 31 forms a toner image on the K-th sheet 3 conveyed by the belt unit 23, and the fixing unit 50 thermally fixes the toner image to the sheet 3.

While executing a printing process on the K-th sheet 3 in S24, the CPU 81 also counts the number of dots on the photosensitive members 40 exposed by each exposure unit 32 based on dot patterns produced in a process for developing the print data (hereinafter called the "number of print dots"), and adds this count to a cumulative dot count stored in the RAM 83, for example. The cumulative dot count is a value proportional to the amount of toner consumed from the toner-accommodating chamber 36 of the corresponding process unit 33. This cumulative dot count is reset to zero when the toner-accommodating chamber 36 is replaced with a new product, for example.

In S25 the CPU 81 determines whether the sheet count K has reached the page count M. If the CPU 81 determines that the sheet count K has not yet reached the page count M (S25: NO), the CPU 81 returns to S22 and repeats the above process. When the CPU 81 determines that the sheet count K has reached the page count M (S25: YES), in S26 the CPU 81 executes a printing process on the M-th sheet 3. While executing a printing process on the M-th sheet 3 in S26, the CPU 81 also counts the number of print dots, and adds this count to the cumulative dot count. Subsequently, the CPU 81 ends the current print control process.

(2) Temperature Control Process

The CPU 81 also executes a temperature control process in parallel with the print control process described above. In S4 of the temperature control process, the CPU 81 first executes a remaining print volume determination process shown in FIG. 5.

(2-1) Remaining Print Volume Determination Process

The remaining print volume determination process is performed to determine which sheet 3 will be passing through the fixing position X2 when a mode switching operation is performed to switch the operating mode of temperature control described later from the high-temperature mode to the low-temperature mode. In the preferred embodiment, the mode switching operation will be performed while the last sheet 3 to be printed is actually passing through the fixing position X2.

Figure 5:
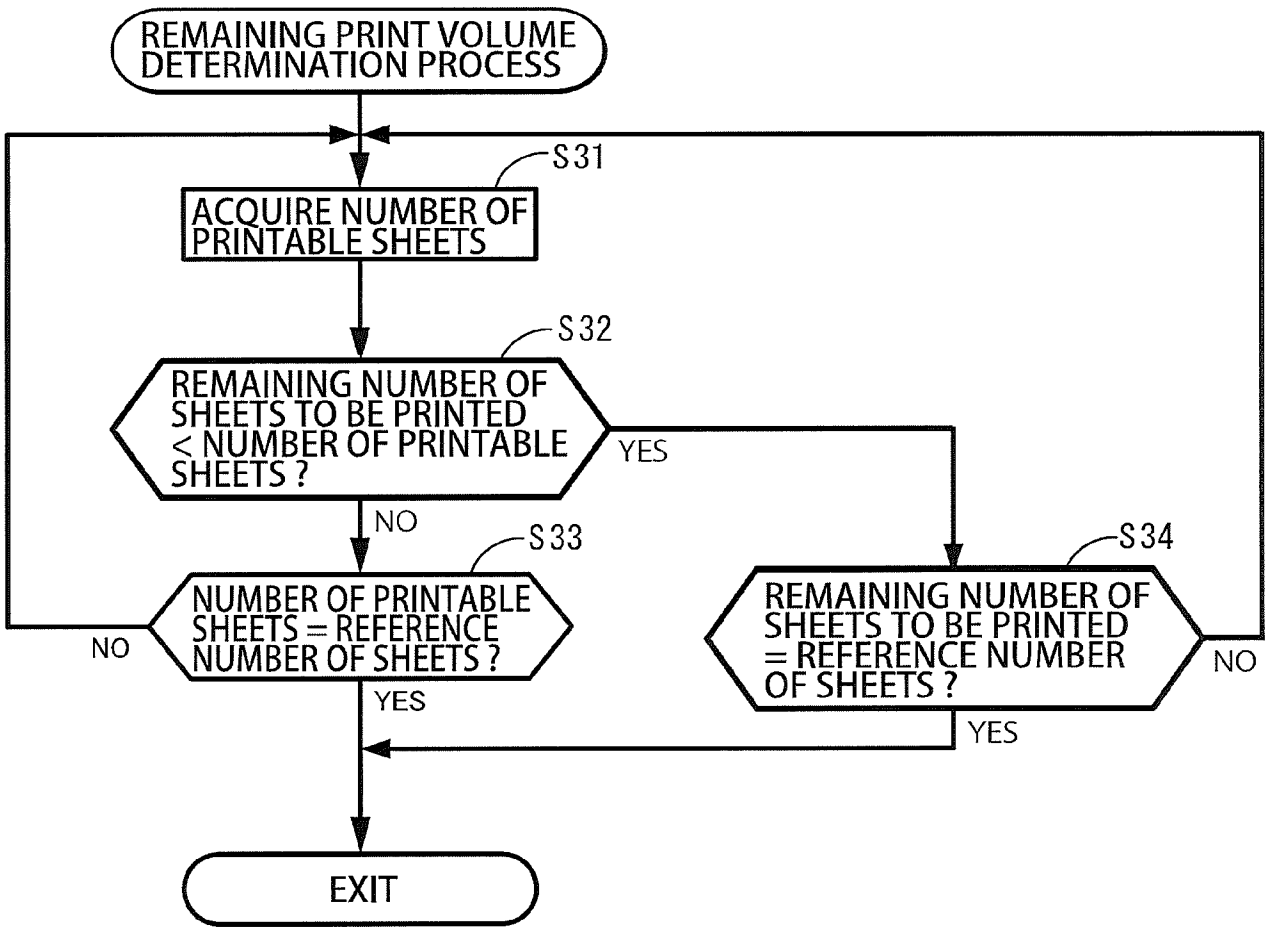
FIG. 5 is a flowchart illustrating a remaining print volume determination process executed by the printer.

In S31 of FIG. 5, the CPU 81 acquires the number of printable sheets. The process of S31 is an example of a maximum sheet quantity acquiring process, and the number of printable sheets is an example of a maximum sheet quantity. The number of printable sheets is set based on the degree of consumption for consumable products used in the printing process and, in this case, is the number of remaining sheets 3 available to execute the printing process. The consumption degree of the consumable products may include the remaining number of sheets 3 in the sheet-accommodating unit 10 and the remaining quantity of toner in the toner-accommodating chambers 36.

The CPU 81 can find the number of remaining sheets 3 based on the detection results of a sensor (not shown) that detects the amount that the lifting member 12 has pushed the sheets 3 upward, and sets the number of printable sheets to this number of remaining sheets. When a sensor (not shown) detects that the pickup roller 21 can no longer convey a sheet 3, then the number of remaining sheets is zero, and the CPU 81 sets the number of printable sheets to zero.

Further, if there are no longer any sheets 3 remaining in the sheet-accommodating unit 10, the CPU 81 determines that the number of remaining sheets is zero by determining that the registration sensor 61 has not detected a sheet 3 for a prescribed reference time after the pickup roller 21 was controlled to perform a feeding operation. Thus, the CPU 81 determines that the number of remaining sheets is zero and sets the number of printable sheets to zero.

The CPU 81 can calculate the amount of remaining toner based on the difference between a reference dot count and the cumulative dot count described above and can set the number of printable sheets based on the amount of remaining toner. Here, the reference dot count is the number of print dots set according to the quantity of toner in a new toner-accommodating chamber 36 and is the sum total of print dots that can be formed by a new product until the toner-accommodating chamber 36 has insufficient toner to perform printing. The CPU 81 counts the number of times that each developing roller 38 rotates, beginning from the moment that the corresponding toner-accommodating chamber 36 was new, estimates the amount of remaining toner in the toner-accommodating chamber 36 based on this number of rotations, and sets the number of printable sheets based on the remaining quantity of toner.

After acquiring the number of printable sheets as described above, the CPU 81 determines whether an execution condition has been met in S32-S34. The execution condition includes a condition in which either the remaining number of sheets to be printed or the number of printable sheets matches a reference number of sheets. The process of S32-S34 is an example of an execution condition determination process. The remaining number of sheets is an example of a remaining sheet quantity and the remaining conveying distance and is the number of sheets required to complete the printing process for the page count M beginning from the current point in time. More specifically, the remaining number of sheets is the number found by subtracting the sheet count K from the page count M.

The reference number of sheets is an example of a parameter-specific predetermined value of the remaining sheet quantity and a parameter-specific predetermined value of the remaining conveying distance, and indicates the conveying distance of sheets after the mode switching operation has been executed and until the printing process based on the print command is completed during which a toner image can be fixed to the sheet 3. In the preferred embodiment, the reference number of sheets is 1. Here, the reference number of sheets is preferably fewer for sheets 3 having a higher heat capacity and greater for a heating roller 51 having a higher heat capacity, for example.

More specifically, in S32 the CPU 81 determines whether the remaining number of sheets to be printed is fewer than the number of printable sheets. If the CPU 81 determines that the remaining number of sheets to be printed is fewer than the number of printable sheets (S32: YES), then a printing process for the required number of sheets to be printed can be completed. Accordingly, in S34 the CPU 81 determines whether the remaining number of sheets to be printed matches the reference number of sheets.

If the CPU 81 determines that the remaining number of sheets to be printed does not match the reference number of sheets (S34: NO), the CPU 81 returns to S31. However, if the remaining number of sheets to be printed does match the reference number of sheets (S34: YES), then the sheet 3 most recently detected by the registration sensor 61 is the final sheet for the printing process, i.e., the M-th sheet 3, and the mode switching operation is performed after this sheet 3 has passed through the fixing position X2. Hence, the CPU 81 completes the current remaining print volume determination process, returns to the process in FIG. 3, and in S5 executes the switch timing setting process shown in FIG. 6.

However, when the CPU 81 determines that the remaining number of sheets to be printed is not fewer than the number of printable sheets (S32: NO), then a printing process for the required number of printing pages cannot be completed and the printing process can only be performed up through the number of printable sheets. Hence, in S33 the CPU 81 determines whether the number of sheets. Hence, in S33 the CPU 81 determines whether the number of printable sheets matches the reference number of sheets. If the CPU 81 determines that the number of printable sheets does not match the reference number of sheets (S33: NO), the CPU 81 returns to S31. However, if the CPU 81 determines that the number of printable sheets matches the reference number of sheets (S33: YES), then the sheet 3 most recently detected by the registration is the final sheet 3 that can be used in the printing process, and the CPU 81 performs the mode switching operation after the sheet 3 has passed through the fixing position X2. Accordingly, the printer 1 completes the current remaining print volume determination process, returns to FIG. 3, and in S5 executes the switch timing setting process shown in FIG. 6.

Here, the CPU 81 may be configured to skip S4 and execute the process in S5 after S3 of FIG. 3, regardless of the remaining number of sheets to be printed. In this case, the CPU 81 is configured to execute the switch timing setting process of S5 and the switch timing determination process of S9 described later after initiating the printing process based on the print command. However, when configured to execute the remaining print volume determination process as described in the embodiment, the CPU 81 can perform the switch timing setting process and the like when the last sheet 3 for which the mode switching operation should be performed is positioned near the fixing position X2. Thus, the CPU 81 configured according to the embodiment can execute the switch timing setting process and the like in an appropriate period based on the remaining number of sheets to be printed and avoids executing the switch timing setting process and the like more often than necessary, unlike a configuration for executing these processes regardless of the remaining number of sheets to be printed.

Further, the execution condition includes the condition that the number of printable sheets matches the reference number of sheets. Thus, the CPU 81 can execute the switch timing setting process and the like in an appropriate period, even when anticipating a halt in the printing process due to an insufficient consumable product, such as the sheets 3 or toner.

(2-2) Switch Timing Setting Process

Figure 6:
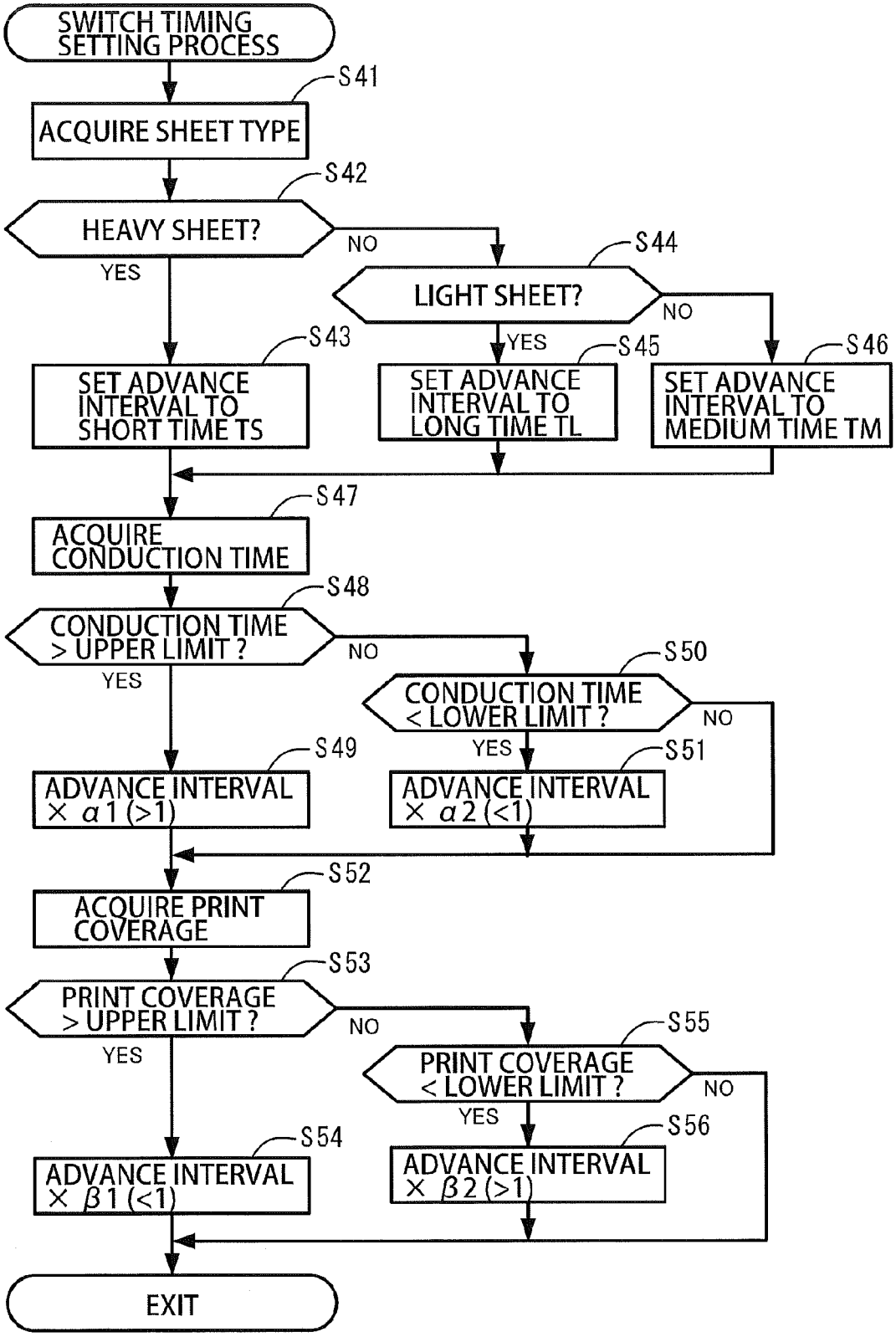
FIG. 6 is a flowchart illustrating a switch timing setting process executed by the printer.

After completing the remaining print volume determination process, the CPU 81 returns to FIG. 3 and in S5 executes the switch timing setting process shown in FIG. 6. The switch timing setting process is performed to set a switch timing at which the CPU 81 executes the mode switching operation. The switch timing precedes the timing at which the trailing edge of the last sheet 3 passes through the fixing position X2 (hereinafter referred to as the "trailing-edge passage timing") by an advance interval (indicated in the top of FIG. 8). In other words, the switch timing is an earlier timing when the advance interval is long and a later timing when the advance interval is short. Further, the advance interval is a length of time in which a toner image can be fixed to the sheet 3 between the switch timing and the trailing-edge passage timing while the CPU 81 controls the temperature of the fixing unit 50 in the low-temperature mode.

More specifically, the advance interval can be found according to the flowing equation or through experiment, for example.

<heat loss $E1$ due to the advance mode switch>≤<residual heat $E2$>+<generated heat $E3$ in low-temperature mode>−<heat loss $E4$> <Equation>

Heat loss E1 due to the advanced mode switch: amount of heat required to fix a toner image to the sheet 4 from the switch timing to the trailing-edge passage timing (equivalent to <required heat value per unit time>×<advance interval>). The heat loss E1 due to the advanced mode switch may also be called the required fixing heat value, which is the quantity of heat required to fix a toner image to the sheet 3 during the advance interval.

Residual heat E2: amount of heat remaining in the fixing unit 50 at the switch timing Generated heat E3 in low-temperature mode: <amount of heat generated per unit time in low-temperature mode>×<advance interval>

Heat loss E4: quantity of heat absorbed by the sheet 3 from switch timing to the trailing-edge passage timing (equivalent to <heat loss per unit time>×<advance interval>)

As can be seen from the above equation, it is preferable to employ a shorter advance interval when the heat capacity of the sheet 3 is great since the amount of heat loss will be larger. Since heavy sheets 3 have a larger heat capacity, the CPU 81 sets the advance interval shorter for heavier sheets 3. Specifically, in S41 of FIG. 6 the CPU 81 acquires the sheet type from the printing conditions included in the print command. The process in S41 is an example of a heat capacity acquiring process, and the sheet type is an example of data correlated with, i.e., proportional to the heat capacity of the sheet.

After acquiring the sheet type, in S42 the CPU 81 determines whether the sheet 3 is heavy sheet. If the sheet type indicates that the sheet 3 is a heavy sheet (S42: YES), in S43 the CPU 81 sets the advance interval to a short time TS, and advances to S47. Specifically, the CPU 81 stores the short time TS and the like in the RAM 83. The advance interval is subsequently multiplied by coefficients $\alpha1$, $\alpha2$, $\beta1$, and/or $\beta2$, depending on various conditions and is overwritten with the new product, as will be described later.

If the sheet 3 is not a heavy sheet (S42: NO), then in S44 the CPU 81 determines whether the sheet 3 is a light sheet. When the CPU 81 determines that the sheet 3 is a light sheet (S44: YES), in S45 the CPU 81 sets the advance interval to a long time TL greater than the short time TS, and subsequently advances to S47.

However, if the sheet 3 is not a light sheet (S44: NO), and hence by default is a normal sheet, in S46 the CPU 81 sets the advance interval to a medium time TM, which is longer than the short time TS and shorter than the long time TL, and subsequently advances to S47.

By delaying the switch timing more when the heat capacity of the sheet 3 is larger in this way, the CPU 81 can reduce the occurrence of poor fixing results while reducing power consumption by the fixing unit 50 an amount suited to the heat capacity of the sheet 3, unlike a configuration using a fixed switch timing without regard to the heat capacity of the sheet 3.

Further, the above equation can increase the advance interval since residual heat in the fixing unit 50 is greater when the electricity conduction time after initial activation is longer. Therefore, the CPU 81 sets the advance interval to a longer interval when the conduction time from activation of the fixing unit 50 to the switch timing is longer. Specifically, in S47 the CPU 81 first acquires the conduction time. The process of S47 is an example of an electricity conduction time acquiring process.

In S48 the CPU 81 determines whether the conduction time is longer than an upper limit. If the conduction time is longer than the upper limit (S48: YES), in S49 the CPU 81 changes the advance interval to a longer interval by multiplying the advance interval set in one of steps S43-S46 by coefficient $\alpha 1$, which is greater than 1. Subsequently, the CPU 81 advances to S52 described later.

However, if the CPU 81 determines that the conduction time is not greater than the upper limit (S48: NO), in S50 the CPU 81 determines whether the conduction time is shorter than a lower limit. If the conduction time is shorter than the lower limit (S50: YES), in S51 the CPU 81 changes the advance interval to a shorter interval by multiplying the advance interval set in one of steps S43-S46 by a coefficient $\alpha 2$, which is smaller than 1. Subsequently, the CPU 81 advances to S52 described later.

If the conduction time is not shorter than the lower limit, meaning that the conduction time is less than or equal to the upper limit and greater than or equal to the lower limit (S50: NO), the CPU 81 advances to S52 without modifying the advance interval set in S43-S46. In this way, the CPU 81 can reduce the occurrence of poor fixing results while reducing power consumption by the fixing unit 50 an amount suited to the heat-generating state of the fixing unit 50, unlike a configuration using a fixed switch timing without regard to the conduction time.

As can be seen from the above equation, it is preferable to shorten the advance interval when the quantity of toner deposited on the sheet 3 is larger because heat loss will be greater. Therefore, the CPU 81 shortens the advance interval when print coverage after the switch timing is great because the quantity of toner deposited on the sheet 3 will be larger. Here, print coverage following the switch timing is the ratio of surface area occupied by the toner image to the surface area of the sheet 3 within the portion of the sheet 3 that passes through the fixing position X2 after the switch timing.

In S52 the CPU 81 first acquires the print coverage following the switch timing. Specifically, the CPU 81 divides the surface area of the toner image from the total surface area of the last sheet 3 within the portion that passes through the fixing position X2 following the switch timing based on the number of print dots used for forming a toner image on the last sheet 3. The CPU 81 then sets the print coverage to this calculated value. Here, print coverage is an example of an image-forming rate, while the process in S52 is an example of an image-forming rate acquiring process.

In S53 the CPU 81 determines whether the print coverage is greater than an upper limit. If the print coverage is greater than the upper limit (S53: YES), in S54 the CPU 81 changes the advance interval to a shorter interval by multiplying the advance interval by a coefficient $\beta 1$, which is smaller than 1. The CPU 81 then ends the current switch timing setting process and advances to S6 in FIG. 3.

However, if the CPU 81 determines that the print coverage is not greater than the upper limit (S53: NO), in S55 the CPU 81 determines whether the print coverage is smaller than a lower limit. If the print coverage is smaller than the lower limit (S55: YES), in S56 the CPU 81 changes the advance interval to a longer interval by multiplying the advance interval by a coefficient $\beta 2$, which is greater than 1. Subsequently, the CPU 81 ends the current switch timing setting process and advances to S6 in FIG. 3.

If the CPU 81 determines that the print coverage is not smaller than the lower limit, meaning that the print coverage is less than or equal to the upper limit and greater than or equal to the lower limit (S55: NO), then the CPU 81 ends the current switch timing setting process without modifying the advance interval, and advances to S6 in FIG. 3. In this way, the CPU 81 can reduce the occurrence of poor fixing results while reducing power consumption by the fixing unit 50 an amount suited to the print coverage, unlike a configuration using a fixed switch timing without regard to the print coverage.

(2-3) Switch Timing Determination Process

After completing the switch timing setting process described above, in S6 of FIG. 3 the CPU 81 measures a total length L1 of the last sheet 3 for the dimension of the sheet 3 in the sub-scanning direction, i.e., the conveying direction. Specifically, the CPU 81 calculates the total length L1 of the last sheet 3 in the conveying direction by multiplying a conveying velocity V of the sheet 3 conveyed by the conveying unit 20 by the time interval from the moment that the registration sensor 61 detects the leading edge of the last sheet 3 until the registration sensor 61 detects the trailing edge of the same sheet 3 (see the difference between detections noted at the top of FIG. 8). This method enables the CPU 81 to measure the total length L1 of the last sheet 3, even when the lengths of all sheets 3 are not uniform.

In S7 the CPU 81 measures a partial length L2 for the portion of the last sheet 3 that has passed through the fixing position X2 at the current point in time. The CPU 81 calculates the partial length L2 by counting the elapsed time from the moment that the discharge sensor 62 detected the leading edge of the sheet 3, multiplies this elapsed time by the conveying velocity V, and adds a distance D (see FIG. 1) from the fixing position X2 to the detection position X4 of the discharge sensor 62. In S8 the CPU 81 calculates the trailing-edge passage timing indicating the time required for the trailing edge of the sheet 3 to pass through the fixing position X2 from the current point in time. Specifically, the CPU 81 calculates the trailing-edge passage timing by subtracting the partial length L2 from the total length L1 of the sheet 3 and dividing the result by the conveying velocity V.

After calculating the trailing-edge passage timing in S8, in S9 the CPU 81 determines whether the switch timing determined by the advance interval set in the switch timing setting process described above has arrived. The process in S9 is an example of a switch timing determination process. The switch timing is an arbitrary point in time between the start and end of the printing process. More specifically, the CPU 81 determines whether the trailing-edge passage timing is equivalent to the advance interval or is less than the advance interval.

If the switch timing has not yet arrived (S9: NO), the CPU 81 returns to S7 and repeats the process in S7-S9. However, if the switch timing has arrived (S9: YES), in S10 the CPU 81 executes the mode switching operation to switch the execution mode of the CPU 81 for controlling the temperature of the fixing unit 50 from the high-temperature mode to the low-temperature mode. Following this switch timing, the CPU 81 continues to control the temperature of the fixing unit 50 in the low-temperature mode until the advance interval has elapsed, and interrupts power to the heat source 51A after the advance interval has elapsed. Subsequently, the CPU 81 ends the current print control and temperature control processes. The process of S10 is an example of a mode switching process. The CPU 81 may also be configured to continue controlling the temperature of the fixing unit 50 in the low-temperature mode after the advance interval has elapsed.

Let us assume that the CPU 81 is configured to continue controlling the temperature of the fixing unit 50 in the high-temperature mode even after the switch timing, and call this Configuration A. A two-dot chain line labeled "comparative temperature" in the first of the three graphs in FIG. 8 indicates the detected temperature of the temperature sensor 60 when the CPU 81 employs Configuration A. In this comparison, the detected temperature is maintained at the high-temperature target value C1 until the trailing-edge passage timing. The detected temperature rises temporarily immediately after the last sheet 3 has passed the fixing position X2, then begins to drop. At this time, as indicated by the two-dot chain line labeled "comparative temperature" in the second graph in FIG. 8, the comparative ambient temperature continues to rise gradually until the trailing-edge passage timing. Immediately after the trailing-edge passage timing, the ambient temperature rises dramatically because the quantity of heat previously absorbed by the sheet 3 at the fixing position X2 is now contributing to the ambient temperature of the fixing unit 50. Consequently, the fixing unit 50 is consuming power unnecessarily.

Figure 8:
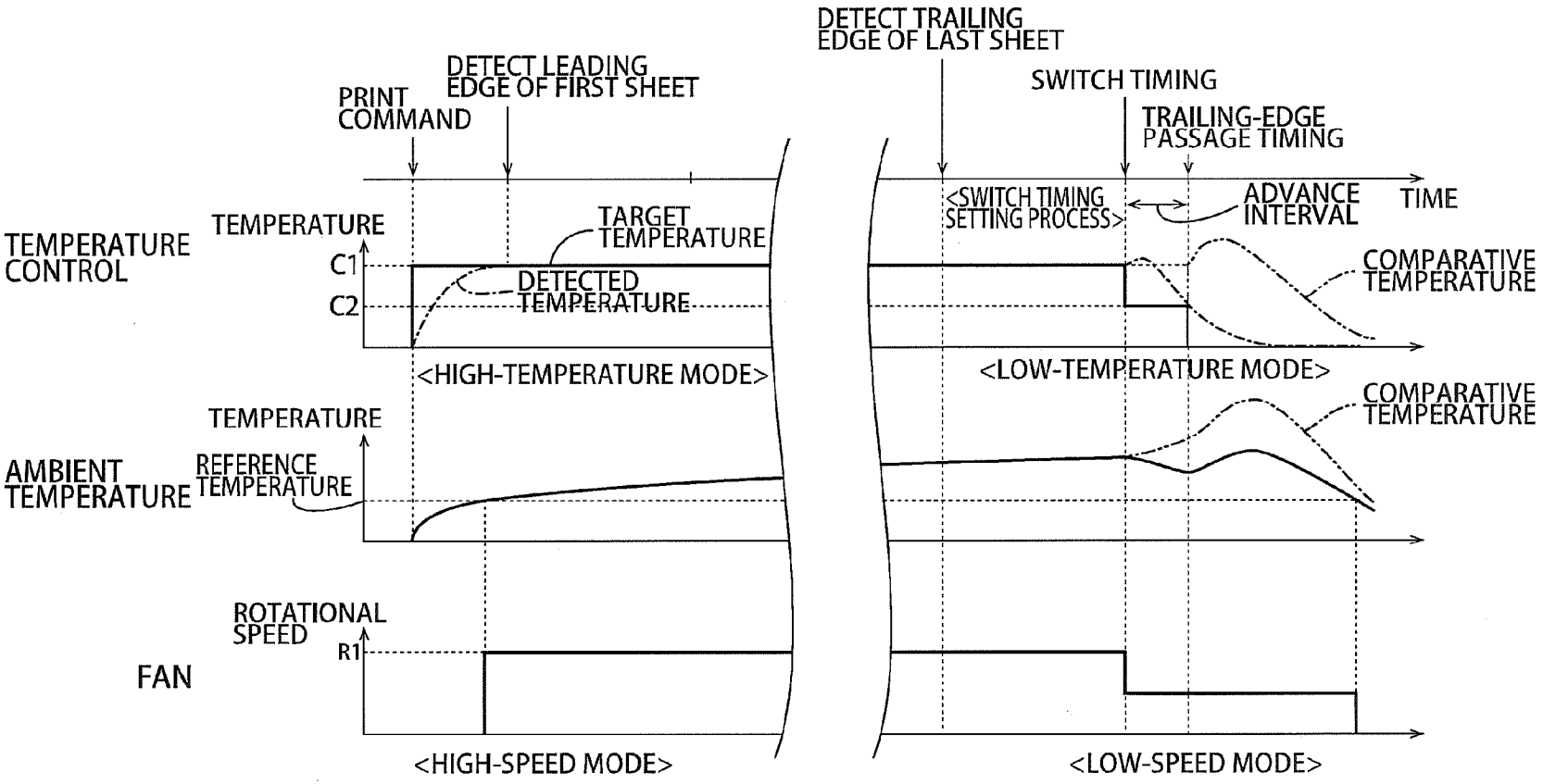
FIG. 8 is graphs showing a switch timing in a mode switching operation and ambient temperature changes.

However, in the preferred embodiment the execution mode of the CPU 81 for controlling the temperature of the fixing unit 50 is switched from the high-temperature mode to the low-temperature mode at the switch timing prior to the trailing-edge passage timing (see the solid line in the first graph of FIG. 8). Accordingly, as indicated by the chain line in the second graph of FIG. 8, the ambient temperature of the fixing unit 50 is restrained from rising dramatically immediately after the trailing-edge passage timing, while suppressing power consumption by the fixing unit 50.

(Fan Control Process)

Figure 7:
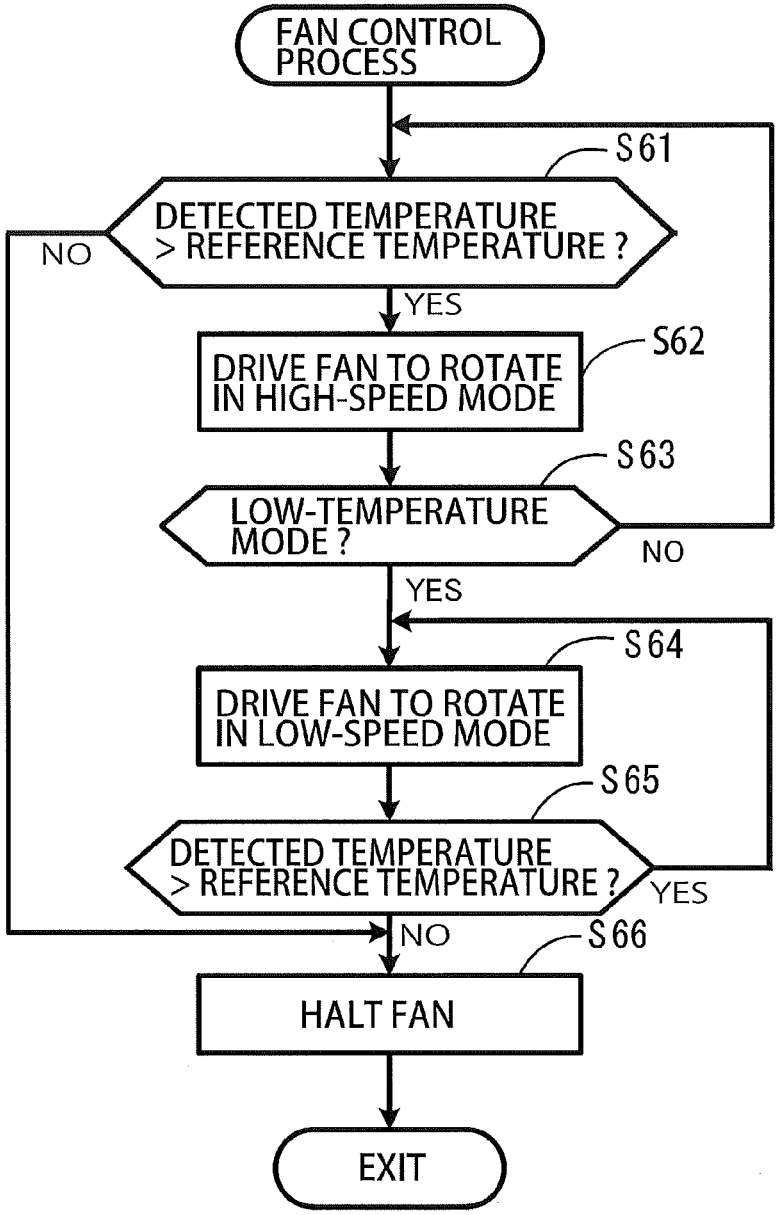
FIG. 7 is a flowchart illustrating a fan control process executed by the printer.

In parallel with the print control process and the temperature control process, the CPU 81 continuously executes a fan control process shown in FIG. 7 at prescribed intervals. The fan control process is performed to make the rotational speed of the fan 70 slower than before executing the mode switching operation for the heat source 51A, i.e., before the switch timing.

More specifically, in S61 the CPU 81 determines whether the ambient temperature detected by the temperature sensor 60 exceeds a reference temperature. The reference temperature is preferably slightly lower than a temperature at the position of the temperature sensor 60 that can affect devices around the fixing unit 50. For example, the reference temperature may be set slightly lower than the temperature at the position of the temperature sensor 60 that is capable of raising the temperature inside the toner-accommodating chamber 36 to a level that fixes toner (45° C., for example). If the CPU 81 determines that the detected temperature does not exceed the reference temperature (S61: NO), in S66 the CPU 81 halts the fan 70 and ends the current fan control process. After a prescribed interval, the CPU 81 repeats the fan control process from the beginning.

If the CPU 81 determines that the detected temperature exceeds the reference temperature (S61: YES), in S62 the CPU 81 drives the fan 70 to rotate in a high-speed mode. The high-speed mode controls the fan 70 to rotate at a high rotational speed R1 capable of keeping the temperature in the casing 2 less than or equal to the reference temperature when controlling the temperature of the fixing unit 50 in the high-temperature mode. This configuration suppresses a rise in the temperature around the fixing unit 50 due to heat produced by the fixing unit 50 when operating in the high-temperature mode.

After beginning to drive the fan 70 in the high-speed mode, in S63 the CPU 81 determines whether the execution mode for controlling the temperature of the fixing unit 50 has been switched to the low-temperature mode. If the CPU 81 determines that the execution mode has not been switched to the low-temperature mode (S63: NO), the CPU 81 returns to S61 and repeats the process described above. However, if the execution mode has been switched to the low-temperature mode (S63: YES), in S64 the CPU 81 switches the execution mode for driving rotations of the fan 70 from the high-speed mode to a low-speed mode.

The low-speed mode is used to control the fan 70 at a low rotational speed R2 capable of maintaining the temperature inside the casing 2 less than or equal to reference temperature when the temperature of the fixing unit 50 is controlled in the low-temperature mode. This configuration can reduce the occurrence of poor fixing operations caused by a drop in the ambient temperature of the fixing unit 50 better than a configuration that maintains the fan 70 in the high-speed mode while controlling the temperature of the fixing unit 50 in the low-temperature mode. Further, this configuration can reduce power consumption by the fan better than a configuration that continues driving the fan 70 to rotate in the high-speed mode after the switch timing. The low-speed mode may also be a mode for halting the fan.

After the CPU 81 begins to control the temperature of the fixing unit 50 in the low-temperature mode, in S65 the CPU 81 determines whether the temperature detected by the temperature sensor 60 exceeds the reference temperature. If the CPU 81 determines that the detected temperature exceeds the reference temperature (S65: YES), the CPU 81 returns to S64 and continues to control the temperature in the low-temperature mode. However, if the CPU 81 determines that the detected temperature does not exceed the reference temperature (S65: NO), in S66 the CPU 81 halts the fan 70 and ends the current fan control process.

Effects of the Embodiment

When the printer 1 according to the preferred embodiment determines that the switch timing has arrived after beginning a printing process and before ending the printing process, the printer 1 sets the amount of heat per unit time generated by the fixing unit 50 below that prior to the switch timing until the printing process has ended. This configuration reduces power consumption by the fixing unit 50 better than a configuration that maintains the heat generated by the fixing unit 50 per unit time at a uniform value until the end of the printing process.

Other Embodiments

While the invention has been described in detail with reference to the embodiment thereof, it would be apparent to those skilled in the art that various changes and modifications may be made therein without departing from the spirit of the invention.

For example, in addition to the tandem-type printer 1 having a multiple transfer system, the image forming device of the present invention may be a printer having a multiple transfer type transfer body system or a multiple development system (multiple rotation system and single pass system). In these cases, the developing devices and charging devices are an example of the image-forming unit. Further, the image forming device may be a printer having a multiple transfer/ intermediate transfer system (intermediate transfer body system and tandem system). In this case, the developing devices and charging devices are an example of the image-forming unit. Further, the image forming device may be a printer employing a polygon scanning system or other type of electro-photographic system, or a printer dedicated to monochromatic printing.

In the preferred embodiment, the control unit 80 is configured to execute the print control and temperature control processes using a single CPU and a memory device. However, the control unit 80 may be configured to execute the print control and temperature control processes with a plurality of CPUs; with only a hardware circuit, such as the ASIC 84 and the like; or with a CPU and a hardware circuit. The printer 1 may also be configured to execute a portion of the printing process described above using the ASIC 84, for example. Further, the print control process, temperature control process, and fan control process may each be implemented with separate CPUs.

The temperature control process of FIG. 3 is not limited to feedback control using detection results from the temperature sensor 60, but may be implemented with feed-forward control for controlling the heat generated by the heat source by applying a fixed control quantity to the heat source that corresponds to the target temperature, for example.

The maximum sheet quantity need not be expressed in units of sheets, but may be specified in units of distance over which the sheet 3 is conveyed when passing through the fixing position X2. The maximum sheet quantity may also be found by multiplying at least two of (1) the conveying distance of the sheet 3 passing through the fixing position X2, (2) the sheet width in the main scanning direction, and (3) the thickness of the sheets 3. For example, the maximum sheet quantity may be the surface area of the sheets 3 conveyed through the fixing position X2 (equivalent to conveying distance× sheet width).

The execution condition in FIG. 5 may include merely the condition that the remaining number of sheets to be printed matches the reference number of sheets. In this case, the CPU 81 need only execute the determination in S34 in the remaining print volume determination process of FIG. 5, with the processes in S31-S33 being unnecessary.

The reference conveyance amount is also not limited to units of sheets, but may be expressed as the distance in which the sheet 3 is conveyed when passing through the fixing position X2. Further, the reference conveyance amount may be found by multiplying at least two of (1) the conveying distance of the sheet 3 passing through the fixing position X2, (2) the sheet width in the main scanning direction, and (3) the thickness of the sheets 3. For example, the maximum sheet quantity may be the surface area of the sheets 3 conveyed through the fixing position X2 (equivalent to conveying distance×sheet width).

"Data correlated with the heat capacity of the sheet" is not limited to the thickness of the sheet 3, but may include the width of the sheet 3 in the main scanning direction and the material composition of the sheet 3, such as paper or plastic, or any other data relative to the heat capacity of the sheet.

In the embodiment described above, the CPU 81 delays the switch timing in the switch timing determination process more when the heat capacity of the sheet 3 is higher. However, the CPU 81 may also reduce the amount of decline in the heat quantity per unit time during the heat quantity reduction process for sheets 3 with a higher heat capacity by increasing the low-temperature target value C2 for the low-temperature mode.

In the process of S52-S56 in FIG. 6, the CPU 81 may employ the number of print dots needed to form the toner image on the last sheet 3 in place of the printing coverage.

In the print control and temperature control processes of FIG. 3, the CPU 81 may be configured to omit one or both of the processes in S4 and S5. Similarly, in the switch timing setting process of FIG. 6, the CPU 81 may be configured to omit one or two of (1) the process related to sheet type, (2) the process related to conduction time, and (3) the process related to printing coverage.

In S10 of FIG. 3, the CPU 81 may be configured to halt conduction of electricity to the heat source 51A rather than switching to the low-temperature mode, provided that the CPU 81 is configured to lower the quantity of heat per unit time produced by the fixing unit 50 from the quantity produced prior to the switch timing.

What is claimed is:

1. An image forming device comprising:

a conveying unit configured to convey a sheet;

a toner container configured to contain toner therein;

a toner-image forming unit configured to form a toner image on the sheet conveyed by the conveying unit using the toner contained in the toner container;

a heating unit configured to generate heat for thermally fixing the toner image to the sheet; and a processor configured to perform a first fixing process wherein the processor controls the heating unit to start generating heat in a first mode, and perform a second fixing process wherein the processor switches the first mode to a second mode at a switch timing ahead of an estimated end timing at which thermal fixing of toner images to all sheets to be consecutively printed is completed, a heat amount per unit time generated by the heating unit in the second mode being smaller than a heat amount per unit time generated by the heating unit in the first mode, wherein the processor is further configured to perform:

a switch timing setting process wherein the processor sets the switch timing while referring to a first parameter relating to a heat capacity of a sheet;

a switch timing determination process wherein the processor determines whether the switch timing has arrived; and a mode switching process wherein the processor switches the first mode to the second mode based on a determination in the switch timing determination process.

2. The image forming device according to claim 1, wherein the processor is further configured to perform:

an execution condition determination process wherein the processor determines that an execution condition is met, the execution condition being variable depending upon a value of at least one of a second plurality of parameters, the execution condition being determined to be met when the value of at least one of the second plurality of parameters has reached a parameter-specific predetermined value, the second plurality of parameters including a remaining sheet quantity that remains unprocessed by the heating unit, a remaining conveying distance needed for conveying the remaining sheet quantity, and a degree of consumption of consumable products used for a toner-image formation on the sheet, wherein, in the switch timing determination process, the processor determines the switch timing in response to the determination that the execution condition is met.

3. The image forming device according to claim 2, wherein the consumable products include the toner contained in the toner container.

4. The image forming device according to claim 2, wherein the consumable products include a sheet on which the toner image is formed.

5. The image forming device according to claim 4, wherein the processor is further configured to perform:

a maximum sheet quantity acquiring process wherein the processor acquires a maximum sheet quantity available for forming the toner image based on a sheet quantity that has been processed by the heating unit, wherein the processor determines that the execution condition is met when the maximum sheet quantity has reached a predetermined sheet quantity value.

6. The image forming device according to claim 1, wherein the processor is further configured to perform a heat capacity acquiring process wherein the processor acquires data correlated with a heat capacity of the sheet, wherein, in the switch timing setting process, the processor delays the switch timing more when the heat capacity of the sheet is larger.

7. The image forming device according to claim 1, wherein the processor is further configured to perform a heat capacity acquiring process wherein the processor acquires data correlated with a heat capacity of the sheet, wherein when the first mode is switched to the second mode, the processor reduces a decline amount in the heat amount per unit time more as the heat capacity of the sheet increases.

8. The image forming device according to claim 1, further comprising a fan provided for adjusting a temperature of the heating unit, wherein the processor is further configured to perform a fan control process wherein the processor slows a rotational speed of the fan after the switch timing has arrived.

9. An image forming device comprising:

a conveying unit configured to convey a sheet;

a toner container configured to contain toner therein;

a toner-image forming unit configured to form a toner image on the sheet conveyed by the conveying unit using the toner contained in the toner container;

a heating unit configured to generate heat for thermally fixing the toner image to the sheet; and a fan provided for adjusting a temperature of the heating unit; and a processor configured to perform a first fixing process wherein the processor controls the heating unit to start generating heat in a first mode, and perform a second fixing process wherein the processor switches the first mode to a second mode at a switch timing ahead of an estimated end timing at which thermal fixing of toner images to all sheets to be consecutively printed is completed, a heat amount per unit time generated by the heating unit in the second mode being smaller than a heat amount per unit time generated by the heating unit in the first mode, wherein the processor is further configured to perform a fan control process wherein the processor slows a rotational speed of the fan after the switch timing arrives.

10. An image forming device comprising:

a conveying unit configured to convey a sheet;

a toner container configured to contain toner therein;

a toner-image forming unit configured to form a toner image on the sheet conveyed by the conveying unit using the toner contained in the toner container;

a heating unit configured to generate heat for thermally fixing the toner image to the sheet; and a processor configured to perform a first fixing process wherein the processor controls the heating unit to start generating heat in a first mode, and perform a second fixing process wherein the processor switches the first mode to a second mode at a switch timing ahead of an estimated end timing at which thermal fixing of toner images to all sheets to be consecutively printed is completed, a heat amount per unit time generated by the heating unit in the second mode being smaller than a heat amount per unit time generated by the heating unit in the first mode, wherein the processor is further configured to perform:

a switch timing setting process wherein the processor sets the switch timing while referring to a first parameter relating to electricity conduction time after initial activation of the heating unit, the electricity conduction time being a duration of time at which the heating unit is powered;

a switch timing determination process wherein the processor determines whether the switch timing has arrived; and a mode switching process wherein the processor switches the first mode to the second mode based on a determination in the switch timing determination process.

11. The image forming device according to claim 10, wherein the processor is further configured to perform an electricity conduction time acquiring process wherein the processor acquires electricity conduction time after initial activation of the heating unit, the electricity conduction time being a duration of time at which the heating unit is powered, wherein, in the switch timing setting process, the processor delays the switch timing more when the electricity conduction time is shorter.

12. The image forming device according to claim 10, wherein the processor is further configured to perform an electricity conduction time acquiring process wherein the processor acquires electricity conduction time after initial activation of the heating unit, the electricity conduction time being a duration of time at which the heating unit is powered, wherein when the first mode is switched to the second mode, the processor reduces a decline amount in the heat amount per unit time more as the electricity conduction time decreases.

13. The image forming device according to claim 10, wherein the processor is further configured to perform:

an execution condition determination process wherein the processor determines that an execution condition is met, the execution condition being variable depending upon a value of at least one of a second plurality of parameters, the execution condition being determined to be met when the value of at least one of the second plurality of parameters has reached a parameter-specific predetermined value, the second plurality of parameters including a remaining sheet quantity that remains unprocessed by the heating unit, a remaining conveying distance needed for conveying the remaining sheet quantity, and a degree of consumption of consumable products used for a toner-image formation on the sheet, wherein, in the switch timing determination process, the processor determines the switch timing in response to the determination that the execution condition is met.

14. The image forming device according to claim 13, wherein the consumable products include the toner contained in the toner container.

15. The image forming device according to claim 13, wherein the consumable products include a sheet on which the toner image is formed.

16. The image forming device according to claim 15, wherein the processor is further configured to perform:

a maximum sheet quantity acquiring process wherein the processor acquires a maximum sheet quantity available for forming the toner image based on a sheet quantity that has been processed by the heating unit, wherein the processor determines that the execution condition is met when the maximum sheet quantity has reached a predetermined sheet quantity value.

17. The image forming device according to claim 10, further comprising a fan provided for adjusting a temperature of the heating unit, wherein the processor is further configured to perform a fan control process wherein the processor slows a rotational speed of the fan after the switch timing has arrived.

18. An image forming device comprising:

a conveying unit configured to convey a sheet;

a toner container configured to contain toner therein;

a toner-image forming unit configured to form a toner image on the sheet conveyed by the conveying unit using the toner contained in the toner container;

a heating unit configured to generate heat for thermally fixing the toner image to the sheet; and a processor configured to perform a first fixing process wherein the processor controls the heating unit to start generating heat in a first mode, and perform a second fixing process wherein the processor switches the first mode to a second mode at a switch timing ahead of an estimated end timing at which thermal fixing of toner images to all sheets to be consecutively printed is completed, a heat amount per unit time generated by the heating unit in the second mode being smaller than a heat amount per unit time generated by the heating unit in the first mode, wherein the processor is further configured to perform:

a switch timing setting process wherein the processor sets the switch timing while referring to a first parameter relating to an image-forming rate, the image-forming rate being a ratio of an area of the toner image to an area of the sheet;

a switch timing determination process wherein the processor determines whether the switch timing has arrived; and a mode switching process wherein the processor switches the first mode to the second mode based on a determination in the switch timing determination process.

19. The image forming device according to claim 18, wherein the processor is further configured to perform an image-forming rate acquiring process wherein the processor acquires data indicative of an image-forming rate, the image-forming rate being a ratio of an area of the toner image to an area of the sheet, wherein, in the switch timing setting process, the processor delays the switch timing more when the image-forming rate is greater.

20. The image forming device according to claim 18, wherein the processor is further configured to perform an image-forming rate acquiring process wherein the processor acquires data indicative of an image-forming rate, the image-forming rate being a ratio of an area of the toner image to an area of the sheet, wherein when the first mode is switched to the second mode, the processor reduces a decline amount in the heat amount per unit time more as the image-forming rate increases.

21. The image forming device according to claim 18, wherein the processor is further configured to perform:

an execution condition determination process wherein the processor determines that an execution condition is met, the execution condition being variable depending upon a value of at least one of a second plurality of parameters, the execution condition being determined to be met when the value of at least one of the second plurality of parameters has reached a parameter-specific predetermined value, the second plurality of parameters including a remaining sheet quantity that remains unprocessed by the heating unit, a remaining conveying distance needed for conveying the remaining sheet quantity, and a degree of consumption of consumable products used for a toner-image formation on the sheet, wherein, in the switch timing determination process, the processor determines the switch timing in response to the determination that the execution condition is met.

22. The image forming device according to claim 21, wherein the consumable products include the toner contained in the toner container.

23. The image forming device according to claim 21, wherein the consumable products include a sheet on which the toner image is formed.

24. The image forming device according to claim 23, wherein the processor is further configured to perform:

a maximum sheet quantity acquiring process wherein the processor acquires a maximum sheet quantity available for forming the toner image based on a sheet quantity that has been processed by the heating unit, wherein the processor determines that the execution condition is met when the maximum sheet quantity has reached a predetermined sheet quantity value.

25. The image forming device according to claim 18, further comprising a fan provided for adjusting a temperature of the heating unit, wherein the processor is further configured to perform a fan control process wherein the processor slows a rotational speed of the fan after the switch timing has arrived.

* * * * *